US006302999B1

(12) United States Patent
Engelhardt et al.

(10) Patent No.: US 6,302,999 B1
(45) Date of Patent: Oct. 16, 2001

(54) METHOD FOR OPTICALLY BRIGHTENING PAPER

(75) Inventors: Thomas Engelhardt, Rheinfelden (DE); Peter Rohringer, Schönenbuch (CH)

(73) Assignee: Ciba Specialty Chemicals Corp., Tarrytown, NY (US)

( * ) Notice: Subject to any disclaimer, the term of this patent is extended or adjusted under 35 U.S.C. 154(b) by 0 days.

(21) Appl. No.: 09/152,986

(22) Filed: Sep. 14, 1998

(30) Foreign Application Priority Data

Sep. 16, 1997 (EP) ..... 97810668

(51) Int. Cl.[7] ..... D21H 19/10; D21H 21/30

(52) U.S. Cl. ..... 162/135; 162/158; 162/162; 162/181.8

(58) Field of Search ..... 162/135, 162, 162/158, 181.8; 106/487

(56) References Cited

U.S. PATENT DOCUMENTS

| | | | | |
|---|---|---|---|---|
| 2,924,549 | * | 2/1960 | Klein et al. | 162/162 |
| 3,240,740 | | 3/1966 | Knapp et al. | 260/29.6 |
| 3,265,654 | | 8/1966 | Glabisch et al. | 260/29.6 |
| 3,547,899 | | 12/1970 | Arlt et al. | 260/79.3 |
| 3,657,174 | | 4/1972 | Glabisch et al. | 260/29.6 |
| 4,888,128 | | 12/1989 | Koll et al. | 252/301.23 |
| 5,374,335 | * | 12/1994 | Lindgren et al. | 162/158 |
| 5,622,749 | | 4/1997 | Rohringer et al. | 427/158 |
| 5,846,382 | | 12/1998 | von Raven | 162/162 |
| 5,916,420 | * | 6/1999 | Wurster et al. | 162/135 |

FOREIGN PATENT DOCUMENTS

| | | |
|---|---|---|
| 42 30 656 | 3/1994 | (DE) . |
| 930393 | 7/1963 | (GB) . |
| 1591322 | 6/1981 | (GB) . |

OTHER PUBLICATIONS

"Fluorescent Whitening Agents", R. Anliker and G. Mueller, 1975, pp. 12–14.

James P. Casey, "Pulp and Paper", pp. 2490–2499.

V. N. Gupta,, "Effect of Metal Ions on Brightness, Bleachability and Colour Reversion of Groundwood", vol. 71, No. 18, (1970), pp. 69–77.

Derwent Abstr. 97–237064/22 for DE 19538029.

Derwent Abstr. 94–093267/12 for DE 4230656.

Derwent Abstr. 36628V/20 for CH 548484.

* cited by examiner

*Primary Examiner*—Peter Chin

(74) *Attorney, Agent, or Firm*—Kevin T. Mansfield

(57) ABSTRACT

A simplified method for the optical brightening of paper either in the pulp mass, the size or metering press or by coating by the use of a formulation of an optical brightening agent together with a swellable layered silicate.

8 Claims, No Drawings

METHOD FOR OPTICALLY BRIGHTENING PAPER

The present invention relates to a simplified method for increasing the whiteness of paper by the application of optical brighteners, also known as fluorescent whitening agents.

Optical brightener formulations together with swellable layered silicates have been described in German laid-open Patent Application 19538029, as additives for detergents with improved properties.

Surprisingly, it has now been found that such formulations can advantageously be utilized for the optical brightening of paper either in the pulp mass, the size press, the metering press or in coating.

The subject of the present invention is hence a method for the optical brightening of paper, which comprises the use of a formulation essentially consisting of a swellable layered silicate and an optical brightener.

The swellable layered silicates are e.g. natural or synthetic clay minerals or sodium silicates. A suitable natural clay mineral is e.g montmorillonite, beidelite, saponite, or hectorite; preferred synthetic species are the zeolites (type A, X or β, etc.) and acid- or alkaline-modified bentonites.

The inventively used formulations may be in the form of a dry mixture or, alternatively, in the form of an aqueous dispersion.

Thereby the known advantages of the swellable layered silicates, which are e.g. natural or synthetic clay minerals or synthetic sodium silicates, such as high opacity, high whiteness, ion-exchange properties and improved retention properties can simply be combined with the properties of the optical brighteners without loosing the desired fluorescence effect of the latter.

Preferably the aqueous formulation contains 0.1 to 15% by weight, preferably 1 to 10% by weight of optical brightener, based on the weight of the swellable layered silicate.

Where the formulation is in the form of an aqueous dispersion, this contains about 2 to 60% by weight of the swellable layered silicate. The preferred range of the bentonites is about 2 to 25%, and mostly preferred 2 to 20%, by weight; for the synthetic zeolites the suitable range is about 2 to 50% by weight.

Dispersing agents, such as polycondensates of naphthalene sulfonic acid and formaldehyde or lignin sulfonates can be used as auxiliaries.

Where the formulation is in the form of a dry mixture, this may contains 0.1 to 90% by weight preferably 1 to 50% by weight of the optical brightener, based on the weight of the swellable layered silicate.

The optical brightener used in the method of the present invention is preferably a derivative of 4,4'-bis-(triazinylamino)-stilbene-2,2'-disulphonic acid, a derivative of 4,4'-distyryl-biphenyl, or a derivative of dibenzofuranyl-biphenyl.

Preferably the 4,4'-bis-(triazinylamino)-stilbene-2,2'-disulphonic acid optical brightener is of the formula:

(1)

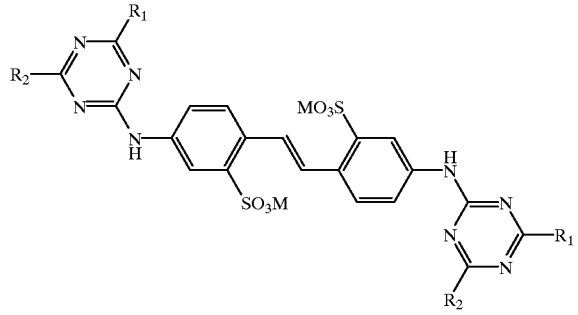

in which $R_1$ and $R_2$, independently, are phenylamino, mono- or disulphonated phenylamino, morpholino, —$N(CH_2CH_2OH)_2$, —$N(CH_3)(CH_2CH_2OH)$, —$NH_2$, —$N(C_1\text{-}C_4\text{alkyl})_2$, —$OCH_3$, —Cl, $NHCH_2CH_2SO_3H$, $CH_2CH_2OH$ or ethanolaminopropionic acid amide; and M is H, Na, Li, K, Ca, Mg, ammonium, or ammonium that is mono-, di-, tri- or tetrasubstituted by $C_1$–$C_4$alkyl, $C_1$–$C_4$hydroxyalkyl or a mixture thereof.

Preferably the 4,4'distyryl-biphenyl optical brightener is of the formula:

(2)

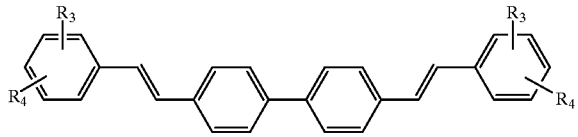

in which $R_3$ and $R_4$, independently, are H, $SO_3M$, $SO_2N(C_1\text{–}C_4\text{alkyl})_2$, $O(C_1\text{–}C_4\text{alkyl})$, CN, Cl, $COO(C_1\text{–}C_4\text{alkyl})$, $CON(C_1\text{–}C_4\text{alkyl})_2$ or $(CH_2)_3N^+(CH_3)_2An^-$, in which M is H, Na, Li, K, Ca, ammonium, or ammonium that is mono-, di-, tri- or tetrasubstituted by $C_1$–$C_4$alkyl, $C_1$–$C_4$hydroxyalkyl or a mixture thereof and An is an anion, e.g. of a mineral acid (hydrochloric or sulfuric acid) or lower $(C_{1\text{-}4})$-carboxylic acid.

Preferably the dibenzofuranylbiphenyl optical brightener is of the formula (3)

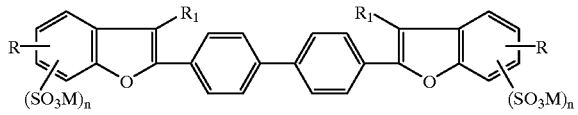

which is unsubstituted or mono- or polysubstituted by radicals R=hydrogen, $C_1$–$C_4$-alkyl, $C_1$–$C_4$-alkoxy, halogen, preferably chlorine, phenoxy and benzyloxy, $R_1$ is hydrogen, $C_1$–$C_4$-alkyl, halogen, preferably chlorine, phenyl, or $SO_3M$, M is hydrogen and/or one equivalent of a non-chromophoric cation and n is zero, 1 or 2.

Preferred compounds of formula (3) are those of the formula (4)

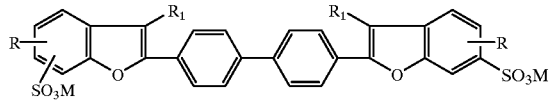

wherein M, R and $R_1$ have the indicated meanings, R and $R_1$ being preferably methyl.

Most preferably the optical brightener is of the formula:

(5)

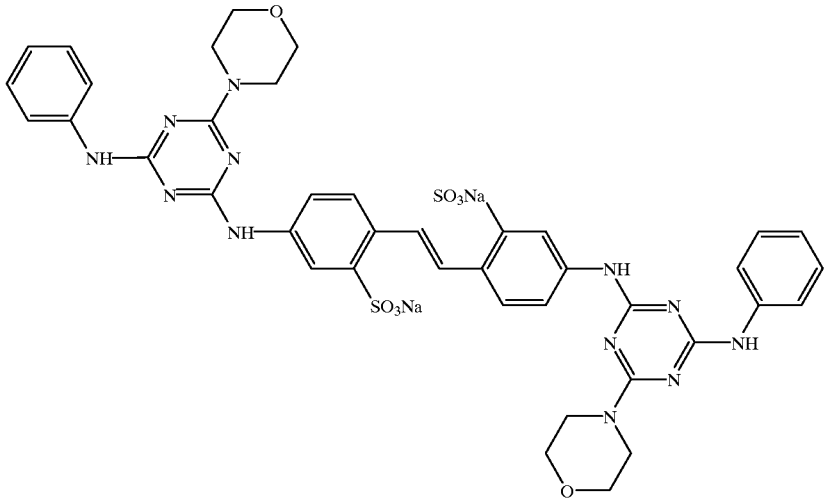

(6)

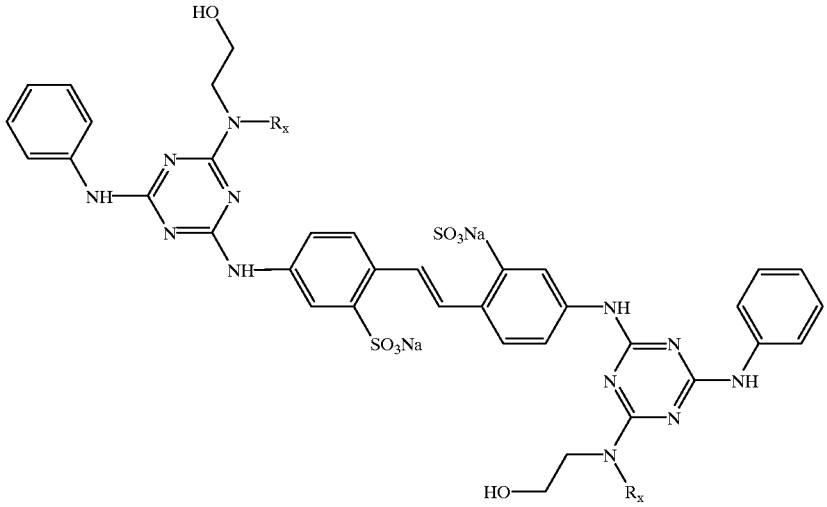

$R_x$ $CH_2CH_2OH$ (6a)
$R_x$ $CH_3$ (6b)

(7)

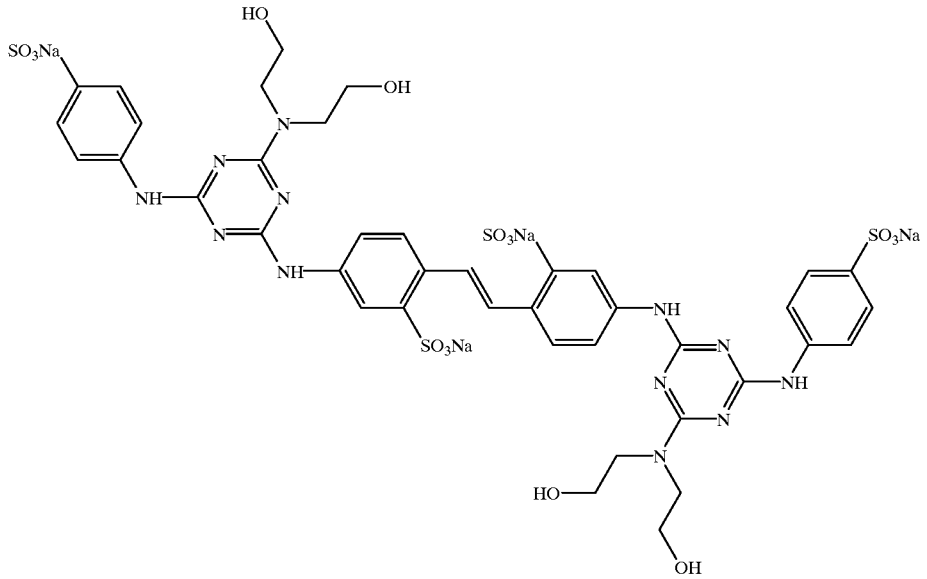

(8)

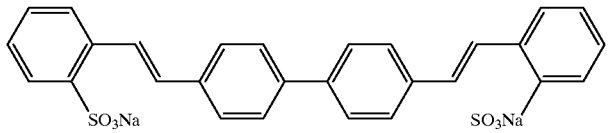

(9)

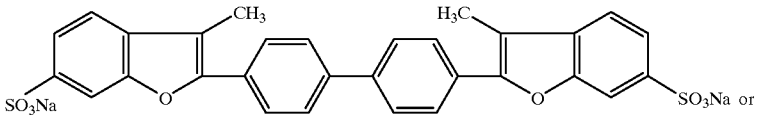

(10)

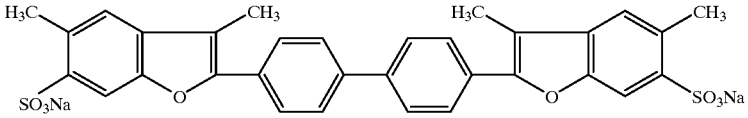

or mixtures of at least two of the compounds (5) to (10).

Using the method of the present invention, it has been found that it is possible to increase the whiteness of a lignin-containing pulp by a process which comprises adding to an aqueous slurry comprising a lignin-containing pulp, during pulp manufacture, prior to the drying step or paper making step if the pulp is not isolated, an effective amount of an optical brightener. While the optical brightener can be added to the aqueous slurry comprising the lignin-containing pulp at any processing step, to minimize losses, it is advantageously added in the latter stages of pulp manufacture, prior to the final dewatering and drying steps. Preferably it is added after completion of the last bleaching step.

By "a lignin-containing pulp" is meant any pulp that still contains about 5% or more of lignin by weight on a dry basis. By definition, lignin is that portion of the pulp which is insoluble in 72 weight percent sulfuric acid. Suitable test procedures for lignin content are given in TAPPI T 223 and ASTM D 1106.

The process of this invention is useful to produce significant whitening of pulps containing from about 5% lignin on a dry weight basis up to 100% of the lignin present in an equivalent amount of wood chips. Thus the process can be employed, e.g. on relatively low-lignin-containing pulps such as certain bleached kraft pulps up to and including higher lignin content pulps such as thermomechanical pulps, bleached chemi-thermomechanical pulps (CTMP), and even deinked bleached thermomechanical pulps. Preferably the pulps contain at least 10% of lignin by weight on a dry weight basis; most preferably they contain at least 15%. The range of brightness that can be obtained varies from about 50 to 90+ depending on starting pulp brightness and the type of pulp employed.

It is known to employ chelating agents in processes to bleach pulps from mechanical pulping processes. See V. N. Gupta, Pulp Paper Mag. Can., 71 (18), T391–399 (1970). The addition of a chelating agent to an aqueous pulp slurry controls the natural yellowing tendency of glucuronic acids, extractives and lignin present in the pulp by removing or minimizing iron and other heavy metals such as copper, zinc and manganese metals that catalyze color-forming side reactions. The iron and other heavy metals are converted into the form of their highly soluble chelates and largely removed in the dewatering steps. This decreases the incorporation of the heavy metal ions into the pulp. Additionally the chelating agent sequesters the salts of iron and other heavy metals which remain and which, in their own right would otherwise relax the excited state of optical brighteners and render them ineffective.

Depending on the processing parameters used in the pulp mill, this metal control step may be done as matter of course in pulping processes where reductive bleaching (e.g., bisulfite, hydrosulfite, or formamidine sulfite bleaching) or oxidative bleaching (e.g., peroxy- or peroxide bleaching) is employed. The addition of a chelating agent to an aqueous pulp slurry, if necessary, should be carried out prior to the addition of the optical brightener.

The background level of residual iron and other heavy metals and their ions in wood chips is generally about 10–25 ppm, although it is rather dependent on geography and species considerations. The amount of iron and other heavy metals and their ions in the water used in pulping mills varies widely. Significant additional amounts of iron and other heavy metals and their ions are introduced during mechanical pulping of wood chips as well as in recycling newsprint. Thus the amount of iron and other heavy metals and their ions in the aqueous pulp during manufacture is may be several hundred parts per million by weight, based on the dry weight of the pulp, at some stages of pulp manufacture.

Often it is not necessary to add a chelating agent prior to addition of the optical brightener due to the common use of peroxy bleaching, which requires prior addition of chelating agents to be effective. However, a chelating agent is advantageously employed if the aqueous slurry comprising the lignin-containing pulp still contains from 25 to 500 ppm by weight, based on the dry weight of the pulp, of salts of iron and other heavy metals at the processing stage where the optical brightener is to be added. At the high end of this range the brightness gain is moderated by iron relaxation of the optical brightener, the dulling of the pulp due to the natural color of the heavy metal salts, and the catalytic effect of the metals on peroxy-species or reductive species (which in turn react with the cellulose and impact pulp properties). Initial levels of salts of iron and other heavy metal ions of 25 to 100 ppm give the biggest improvement in brightness when the aqueous pulping slurry is treated with a chelating agent prior to combination with an optical brightener. In general there is no practical advantage to reducing the content of iron and other heavy metals and their ions below the residual background level found in the wood chips.

Heavy metal contents can be determined by standard analytical procedures such as atomic absorption spectroscopy or inductively coupled plasma analysis. Once the type and amounts of the various heavy metals are known, the amount of the chelating agent to employ to reach 100 ppm or less, preferably about 25 ppm or less, can readily be calculated or determined from tables. It is not harmful to use a small excess. Thus, depending on the heavy metal content of the aqueous pulping slurry prior to the addition of the optical bightener, the chelating agent selected and the degree of whiteness improvement desired, from 0 up to about 1% by weight, based on the dry weight of the pulp, of a chelating agent may be advantageously employed An additional and substantial benefit of chelate treatment is to open the fiber matrix to make it more accessible to the optical brightener.

All types of chelating agents are suitable in the present invention, i.e. those that offer thermodynamic or kinetic control of metal ions. However preference is given to chelating agents that offer thermodynamic control, that is, chelating agents that form a stable, isolable, complex with a heavy metal ion. Within this group it is particularly preferred to use aminocarboxylic acid chelates. Well known and commercially available members of this class include ethylenediaminetetraacetic acid (EDTA), diethylenetriaminepentaacetic acid (DTPA), hydroxyethylethylenediaminetriacetic acid (HEDTA) and nitrilotriacetic acid (NTA).

Mixtures of thermodynamic and kinetic-controlling chelating agents (e.g. citrates, keto acids, gluconates, heptagluconates, phosphates, and phosphonates ) also work well in reducing the content of free heavy metal ions in the pulp to acceptable levels. A number of these kinetic-controlling chelating agents are also commercially available. Kinetic controlling chelating agents are those which do not form a stable, isolable, complex with a heavy metal ion.

When used for the fluorescent whitening of paper, the formulations according to the present invention may also be applied to the paper substrate in the form of a paper coating composition or directly in the size press.

In a second aspect, the present invention provides a method for the fluorescent whitening of a paper surface, comprising contacting the paper surface with a coating composition comprising a white pigment; a binder dispersion; optionally a water-soluble co-binder; and sufficient of a formulation according to the present invention, to ensure that the treated paper contains 0.01 to 2% by weight, preferably 0.01 to 1% by weight, based on the white pigment, of the optical brightener (parts of the optical brightener per 100 parts of the pigment).

As the white pigment component of the paper coating composition used according to the method of the present invention, there are preferred inorganic pigments, e.g., aluminium or magnesium silicates, such as China clay and kaolin and, further, barium sulfate, satin white, titanium dioxide, calcium carbonate (chalk) or talcum; as well as white organic pigments.

The paper coating compositions used according to the method of the present invention may contain, as binder, inter alia, plastics dispersions based on copolymers of butadiene/styrene, acrylonitrile/butadiene/styrene, acrylic acid esters, acrylic acid esters/styrene/acrylonitrile, ethylene/vinyl chloride and ethylene/vinyl acetate; or homopolymers, such as polyvinyl chloride, polyvinylidene chloride, polyethylene and polyvinyl acetate or polyurethanes. A preferred binder consists of styrene/butyl acrylate or styrene/butadiene/acrylic acid copolymers or styrene/butadiene rubbers. Other polymer latices are described, for example, in U.S. Pat. Nos. 3,265,654, 3,657,174, 3,547,899 and 3,240,740.

The optional water-soluble protective colloid may be, e.g., soya protein, casein, carboxymethylcellulose, natural or modified starch, chitosan or a derivative thereof or, especially, polyvinyl alcohol. The preferred polyvinyl alcohol protective colloid component may have a wide range of saponification levels and molecular weights; e.g. a saponification level ranging from 40 to 100; and an average molecular weight ranging from 10,000 to 100,000.

Recipes for coating compositions for paper are described, for example, in J. P. Casey "Pulp and Paper"; Chemistry and Chemical Technology, 2nd edition, Volume III, pages 1684–1649 and in "Pulp and Paper Manufacture", 2nd and 5th edition, Volume II, page 497 (McGraw-Hill).

The paper coating compositions used according to the method of the present invention preferably contain 10 to 70% by weight of a white pigment. The binder is preferably used in an amount which is sufficient to make the dry content of polymeric compound up to 1 to 30% by weight, preferably 5 to 25% by weight, of the white pigment. The amount of optical brightener preparation used according to the invention is calculated so that the optical brightener is preferably present in amounts of 0.01 to 1% by weight, more preferably 0.05 to 1% by weight, and especially 0.05 to 0.6% by weight, based on the white pigment.

The paper coating composition used in the method according to the invention can be prepared by mixing the components in any desired sequence at temperature from 10 to 100° C., preferably 20 to 80° C. The components here also include the customary auxiliaries which can be added to regulate the rheological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, copolymers of ethylene oxide and propylene oxide, polyvinyl alcohol, water-soluble condensation products of formaldehyde with urea or melamine, polyphosphates or polyacrylic acid salts.

The coating composition used according to the method of the present invention is preferably used to produce coated printed or writing paper, or special papers such as cardboard or photographic papers.

The coating composition used according to the method of the invention can be applied to the substrate by any conventional process, for example with an air blade, a coating blade, a roller, a doctor blade or a rod, or in the size press, after which the coatings are dried at paper surface temperatures in the range from 70 to 200° C., preferably 90 to 130° C., to a residual moisture content of 3–8%, for example with infra-red dryers and/or hot-air dryers. Comparably high degrees of whiteness are thus achieved even at low drying temperatures.

By the use of the method according to the invention, the coatings obtained are distinguished by optimum distribution of the dispersion optical brightener over the entire surface and by an increase in the level of whiteness thereby achieved, by a high fastness to light and to elevated temperature (e.g. stability for 24 hours at 60–100° C.) and excellent bleed-fastness to water.

In a third aspect, the present invention provides a method for the optical brightening of a paper surface comprising contacting the paper in the size press or metering press with an aqueous preparation containing a size, optionally an inorganic or organic pigment and 0.1 to 20 g/l of an optical brightener. Preferably, the size is starch, a starch derivative or a synthetic sizing agent, especially a water-soluble copolymer.

The layered silicates consist of natural or synthetic clay minerals or a layered sodium silicate, whereby the clay mineral is preferably montmorillonite, beidellite, saponite or hectorite.

The montmorillonite can be used in the sodium or calcium form or, respectively in the form of a calcium montmorillonite having been ion-exchanged with soda. Synthetically prepared clay minerals of the above named groups may also be used. Alternatively, synthetic layer-type sodium silicates (for example the commercial product SKS 6 from Hoechst AG) can also be employed.

These layered silicates possess the property, by means of internal crystalline swelling, of being able to intercalate polar agents between the silicate lamella, resulting, at higher concentrations, in an increase in the distance between the layers.

Since agglomerates of naturally occurring layered silicates may have a beige, gray or yellow appearance, the agglomerate particles of the formulation are preferably sheathed with a synthetic zeolite or layer-type sodium silicate (preferably ca 3 to 15% by weight) in order to increase their whiteness. Further preferred alternatives for disguising the colouration of the formulation are either the addition of "bluing" dyes or pigments, for example Unidisperse$^{RTM}$ Blue B-E (commercial product of Ciba Specialty Chemicals Inc.), preferably in amounts of 0.3 to 5% by weight or the addition of coloured active substances such as the photobleaching agent Tinolux$^{RTM}$ BB (commercial product of Ciba Specialty Chemicals Inc.), preferably in amounts of 0.3 to 5% by weight.

The process for the preparation of the formulations used in the method of the present invention is described in detail in German laid-open Patent Application 19538029.

These formulations provide an improved distribution of the optical brightener within the paper, a more exact and simplified addition of the brightening agent to the paper and better protection of the brightener against the influences of light and oxygen.

The following examples further illustrate the invention. Parts and percentages are by weight unless otherwise stated.

EXAMPLE 1

5.0 g of bentonite (Bentonit EX 0242®, Südchemie AG) are dispersed in 15 ml of deionised water containing 0.75 g of the compound of formula (5) under rapid stirring, so that the resulting slurry (dispersion) has a solids content of 25%.

0.27 g of this dispersion (=0.068 g of bentonite and 0.01 g of the optical brightener) are added to 5 g of dry-bleached CTMP short fibers (pulp), suspended in 150 ml of water (hardness 100 ppm CaO).

The mixture is agitated for 15 minutes, then 0.03% of a cationic retention aid (Percol 292®) is added, and finally a handsheet is formed by using the Rapid Koethen system. The dryed paper has an area weight of 160 g/m$^2$.

The determination of the fluorescence is performed with a Datacolor Spectraflash 500. The ISO-brightness is determined with and without a cut-off filter at 420 nm and the difference between these two measurements is the fluorescence.

The ISO-brightness rises from 79.9 to 87.1, which results in a fluorescence value of 7.2.

EXAMPLE 2

Example 1 is repeated but using a slurry prepared from 5.0 g of the bentonite and 0.25 g of the compound of formula (8).

The ISO-brightness of the resulting paper increases from its initial value of 79.9 to 87.3, which results in a fluorescence value of 7.4.

EXAMPLE 3

2.5 g of bentonite (Bentonite EX 0242®- Südchemie AG) or zeolite (Wessalith P80.6® Degussa AG) are dispersed in 7.5 g of an aqueous solution of 0.1 g of an optical brightener. 1 g of this suspension (=0.25 g of bentonite or zeolite and 0.01 g of the optical brightener) is added to 5 g of dry-bleached CTMP short fibers (pulp), suspended in 150 ml of water (hardness 100 ppm CaO).

The mixture is agitated for 15 minutes, then 0.03% of a cationic retention aid (Percol 292®) is added, and finally a handsheet is formed by using the Rapid Koethen system. The dryed paper has an area weight of 160 g/m$^2$.

The following table shows the fluorescence values which are determined as in the foregoing Examples.

| | Optical brightener (compound of formula) | fluorescence (difference[1]) |
|---|---|---|
| bentonite | (6a) | (90.2 – 79.7) = 10.5 |
| bentonite | (6b) | (90.2 – 79.7) = 10.5 |
| bentonite | (5) | (89.5 – 79.7) = 9.8 |
| zeolite (powder) | (6a) | (90.4 – 80.6) = 9.8 |
| zeolite (powder) | (6b) | (90.5 – 80.6) = 9.9 |
| zeolite (powder) | (5) | (90.0 – 80.6) = 9.4 |
| zeolite (granules) | (6a) | (90.0 – 80.4) = 9.6 |
| zeolite (granules) | (6b) | (90.4 – 80.4) = 10.0 |
| zeolite (granules) | (5) | (89.4 – 80.4) = 9.0 |

[1]difference between resulting value and initial value (= without an optical brightener)

Analogous results are obtained when using the optical brighteners of formula (9) or (10).

What is claimed is:

1. A method for the optical brightening of paper, which comprises adding to a pulp or a paper a formulation consisting essentially of an aqueous dispersion containing 2 to 60% by weight of synthetic bentonite and an optical brightener which is a derivative of 4,4'-bis-(triazinylamino)-stilbene-2,2'-disulfonic acid.

2. A method according to claim 1, wherein the optical brightener is of the formula:

(5)

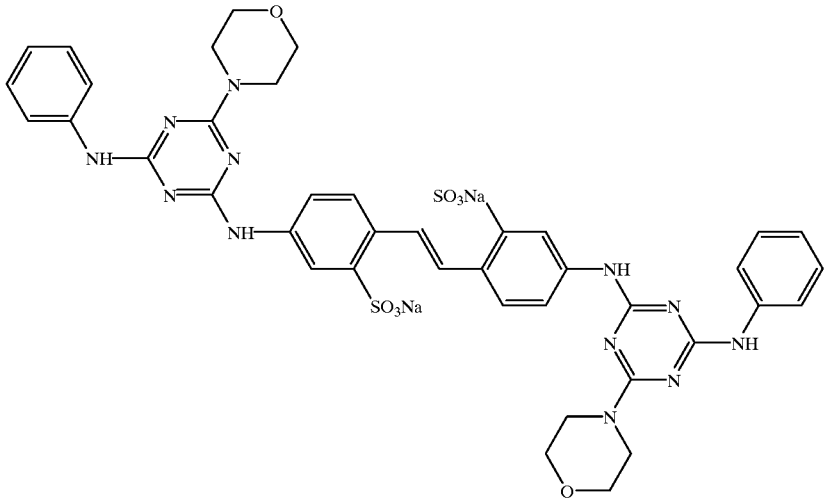

(6)

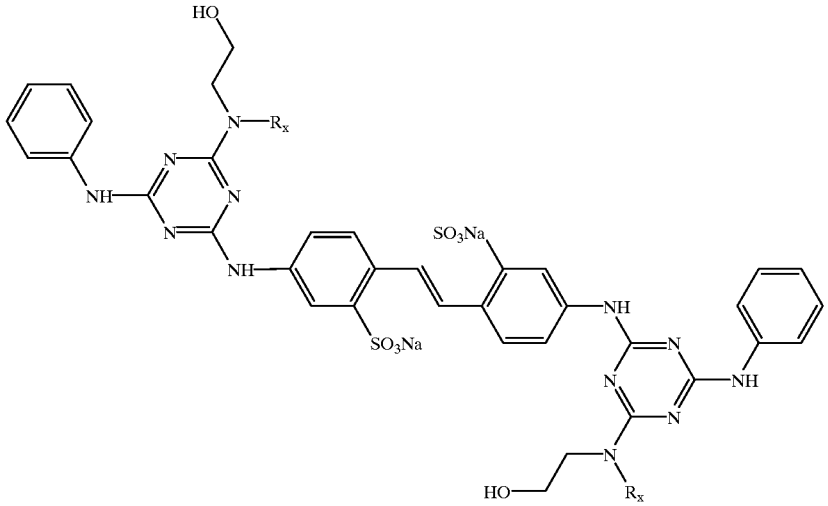

in which $R_x$ is $CH_2CH_2OH$ in formula (6a) or $R_x$ is $CH_3$ in formula (6b), or (7)

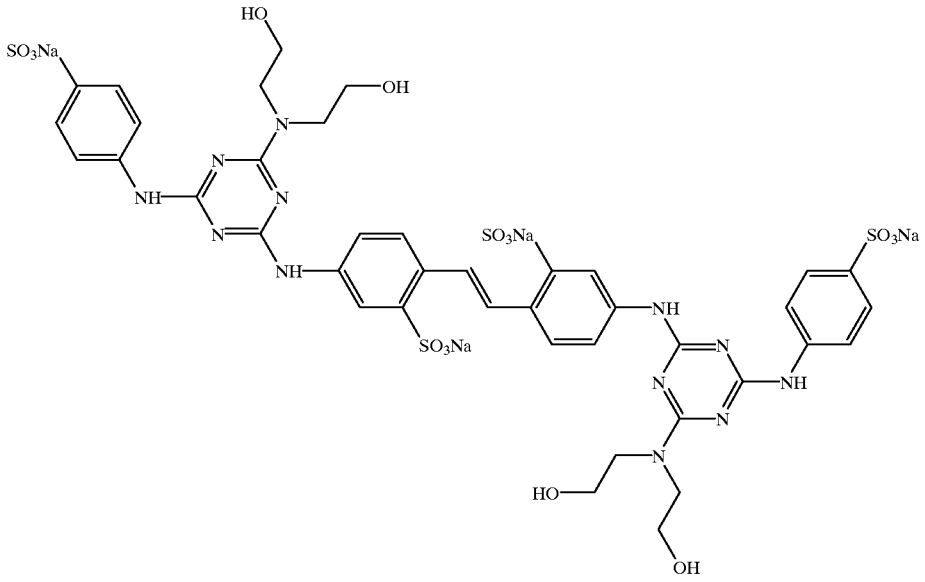

or a mixture of at least two compounds of the formulae (5) to (7).

3. A method according to claim 1, wherein the 4,4'-bis-(triazinylamino)-stilbene-2,2'-disulphonic acid optical brightener is of the formula:

(1)

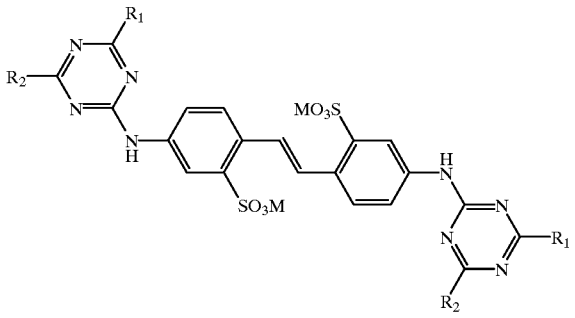

in which $R_1$ and $R_2$, independently, are phenylamino, mono- or disulphonated phenylamino, morpholino, $—N(CH_2CH_2OH)_2$, $—N(CH_3)(CH_2CH_2OH)$, $—NH_2$, $—N(C_1–C_4alkyl)_2$, $—OCH_3$, —Cl, $NHCH_2CH_2SO_3H$, $CH_2CH_2OH$ or ethanolaminopropionic acid amide; and M is H, Na, Li, K, Ca, Mg, ammonium, or ammonium that is mono-, di-, tri- or tetrasubstituted by $C_1–C_4$alkyl, $C_1–C_4$hydroxyalkyl or a mixture thereof.

4. A method according to claim 1, in which the formulation is added to the pulp mass.

5. A method according to claim 1, in which the formulation is used for paper coating.

6. A method according to claim 1, in which the formulation is added to the size press or metering press.

7. Paper which has been optically brightened by the method according to claim 1.

8. A method according to claim 1, wherein the aqueous dispersion contains 2 to 25% by weight of synthetic bentonite.

* * * * *